United States Patent [19]

Faucillon

[11] 4,343,400

[45] Aug. 10, 1982

[54] CONTAINER CRATE THAT CAN BE STACKED OR NESTED

[75] Inventor: Michel Faucillon, Baillet en France, France

[73] Assignee: Allibert, S.A., Grenoble, France

[21] Appl. No.: 197,877

[22] Filed: Oct. 17, 1980

[30] Foreign Application Priority Data

Oct. 17, 1979 [FR] France ..... 79 25779

[51] Int. Cl.[3] ..... B65D 21/04; B65D 25/04

[52] U.S. Cl. ..... 206/507; 206/518; 220/20; 220/22; 220/23.8

[58] Field of Search ..... 206/507, 518; 220/23.8, 220/20, 22; 229/6 A

[56] References Cited

U.S. PATENT DOCUMENTS

| | | | |
|---|---|---|---|
| 2,147,675 | 2/1939 | Shoemaker | 229/6 A |
| 2,638,827 | 5/1953 | Lau | 206/507 |
| 2,652,702 | 9/1953 | Hintze | 220/23.8 |
| 2,758,750 | 8/1956 | Stroop | 206/507 |
| 2,814,408 | 11/1957 | Zebartl | 229/6 A |
| 3,104,044 | 9/1963 | Reifers | 229/2.5 |
| 3,197,058 | 7/1965 | Hale | 206/507 |
| 3,203,573 | 8/1965 | Rowe | 206/507 |
| 3,326,186 | 6/1967 | Doll | 119/19 |
| 3,502,241 | 3/1970 | Smith | 220/23.8 |
| 3,696,966 | 10/1972 | Iterolzer | 206/518 |

FOREIGN PATENT DOCUMENTS

| | | |
|---|---|---|
| 494681 | 9/1970 | Switzerland . |
| 1143926 | 2/1969 | United Kingdom . |

*Primary Examiner*—George E. Lowrance
*Attorney, Agent, or Firm*—Pollock, Vande Sande & Priddy

[57] ABSTRACT

The invention relates to a container crate of the type that can be stacked or nested and made of molded plastic. According to the invention, the crate is divided into two compartments by an internal partition having a downwardly opening groove and containing apertures therein for ventilation. The crate has particular application for the shipment of small live animals.

5 Claims, 7 Drawing Figures

CONTAINER CRATE THAT CAN BE STACKED OR NESTED

FIELD OF THE INVENTION

This invention relates to improved container crates of the type that can be stacked within one another as well as on top of each other.

BRIEF DESCRIPTION OF THE PRIOR ART

Container crates of molded plastic or similar construction are known, which comprise the usual bottom surface and four sides forming a basically rectangular container. Two crates can be rotated 90 degrees in relation to each other to provide two stacking possibilities: they can either be stacked to nest within one another with considerable overlap of the sides. This permits compact storage or shipment of empties. Or they can be stacked on top of each other with very little overlap, but in interlocked relation to prevent the stacked crates from sliding. The latter method of stacking with very little overlap of the sides is known in the trade as "stacking," while crates that can be stacked to fit inside each other are said to be "stackable" and nesting.

This type of container crate is generally used for shipping a variety of objects. In the area of poultry farming, plastic crates are desirable because they are lightweight, rigid and can be re-used, as they are easy to clean for compliance with the requirements of good sanitary practices. However, there are a number of problems related to these crates, especially as concerns the proper dimensions for ease of handling and for the comfort of animals to be shipped.

BRIEF DESCRIPTION OF THE PRESENT INVENTION

This invention describes an improved container crate that provides the qualities desired. According to the invention, the container crate of molded plastic or similar construction comprises a bottom and four sides forming a basically rectangular container that can be rotated 90 degrees in relation to other crates to provide the two mentioned stacking possibilities: either stacking so that the crates nest within one another with considerable overlap of the sides, for compact storage or shipment of empties; or stacking the crates on top of each other with very little overlap, but with the crates interlocked to prevent the crates from sliding. The invention is novel in that it comprises:

at least one partition parallel to two of the sides and which divides the space of the crate into at least two compartments, said partition protruding from the bottom of the crate and forming a ridge at the top and having the cross sectional shape of an inverted V or an inverted, symmetrical, short-stemmed Y which creates a downward-opening groove between the two compartments;

at least one reinforcing tab which connects the two sides of the above-mentioned V near the bottom of the crate;

and, at least one notch or slot through the upper part of said partition for insertion of the tab of a crate below when the crates are being stacked to nest within one another.

Thus, the container crate may be divided into as many compartments as desired to assure the comfort of animals to be shipped, and its outer dimensions may be chosen to comply with optimal handling features.

According to another feature of the invention, the abovesaid partition includes apertures at least in both sides of the V, placed below the apex of the V, under the ridge at the top. This improves the compartments' ventilation.

According to another feature of the invention, the ridge at the top of the partition supports the bottom of a crate set on top when the crates are being stacked on top of each other. Each stacked crate is supported from below by a lower crate's upper edge on two sides and along its entire length by a cross-wise positioned partition of the lower crate.

Other features and advantages of the invention will become apparent in the description below, which refers to the attached diagrams in which:

DETAILED DESCRIPTION OF THE INVENTION

Figure 1:
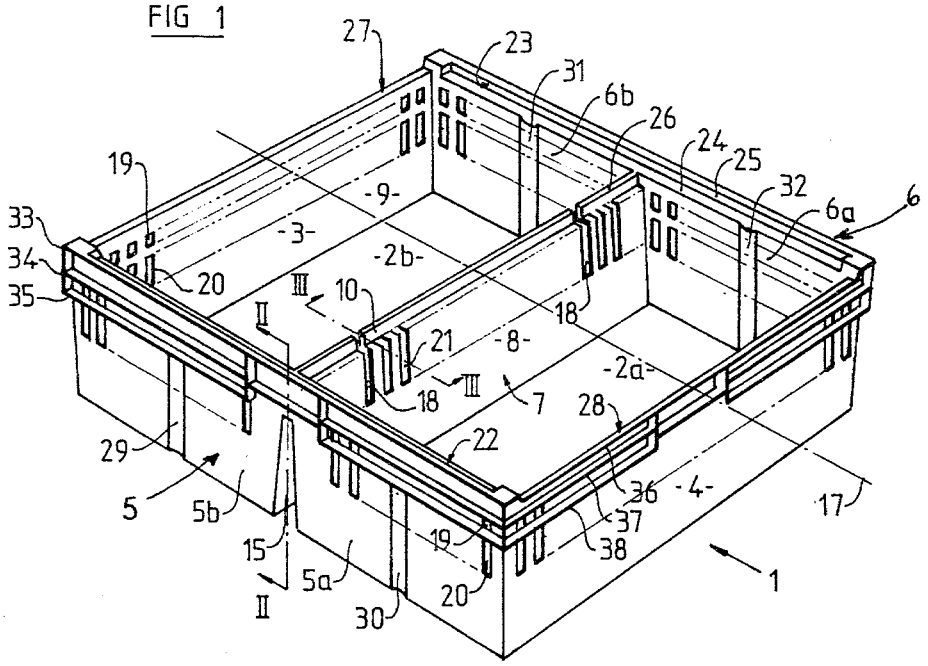
FIG. 1 is a perspective drawing of a container crate according to the invention.

According to the construction shown in the drawings, a crate 1 comprises a bottom formed in two sections *2a, 2b* and four sides 3, 4, 5 and 6 extending upward from the bottom.

Figure 3:
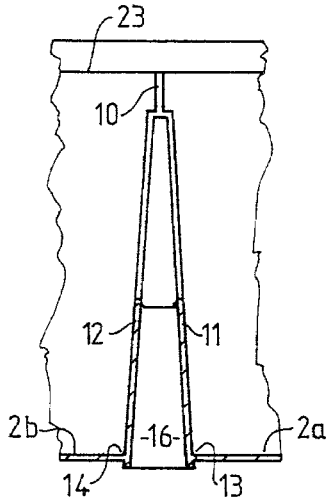
FIG. 3 is a cross-section through the partition, taken along section line III—III of FIG. 1.

A partition 7 extends parallel to sides 3 and 4 and divides the crate into two compartments 8, 9 which are approximately equal in size. The partition 7 has a bifurcated cross-piece, shown in FIG. 3, which is basically an inverted V, or, more specifically, is in the shape of a symmetrical, inverted Y with a short ridge 10 at the top of the partition, and two sides, 11, 12, joined to the crate bottom along edges 13, 14. In this way, a downward-opening groove 15 is formed between the two compartments 8, 9 of the crate.

Figure 2:
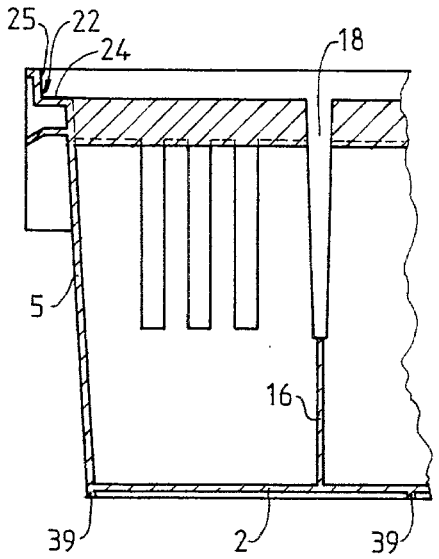
FIG. 2 is a partial cross-sectional view through the partition and taken along section line II—II of FIG. 1.
Figure 7:
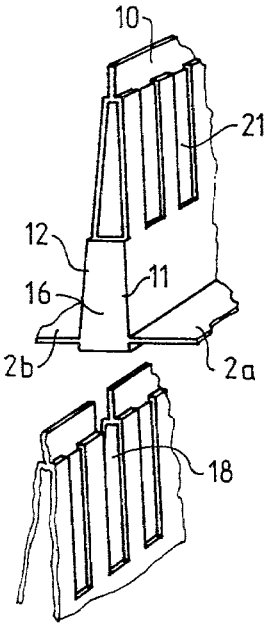
FIG. 7 is a drawing in perspective with a cut-away view showing how the reinforcing tab on one crate interlocks with the slot in the partition of a crate beneath it, when the crates are being stacked to nest one within the other.

To provide proper rigidity to the crate and to ensure that the two compartments 8 and 9 are solidly connected, two upstanding tabs 16 (see FIGS. 2, 3 and 7 in particular) are provided near the bottom of the crate, and they are integrally connected to the two sides 11 and 12 of partition 7. These tabs 16 are advantageously positioned inwardly adjacent sides 5 and 6 and are symmetrical in relation to the crate's plane of symmetry 17, parallel to sides 5 and 6. As shown in FIGS. 2 and 7, notches or slots 18 are formed in partition 7, above tabs 16, so that tabs 16 will fit into mating notches or slots of an adjacent crate when the crates are nested one within the other.

Figure 5:
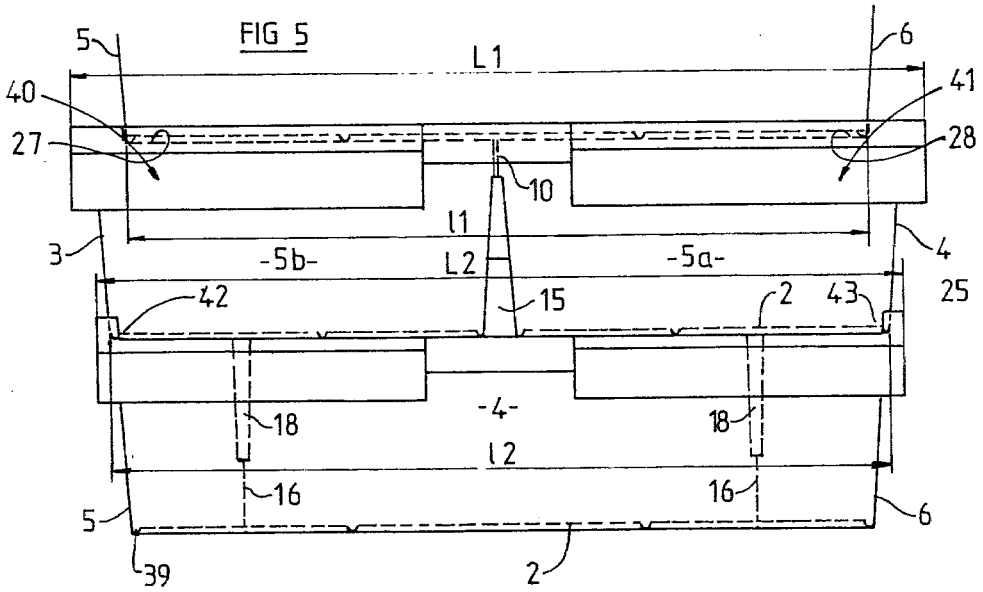
FIG. 5 is an elevational view of stacked crates.

All sides of the crate contain openings such as 19 and 20. Partition 7 contains apertures 21 in sides 11 and 12, positioned below the top ridge 10. Sides 5 and 6 of the crate have edges 22, 23. As FIGS. 1 and 3 clearly show, each edge such as edge 23 comprises a step-down shoulder 24 parallel to the bottom and level with the top surface 26 of ridge 10 at the top of partition 7. Edge 23 further includes vertical surface 25 which rises at an obtuse angle (FIG. 2) to ensure proper positioning of the crates when they are stacked one on top of the other as shown in FIG. 5. The two other sides, 3 and 4, of the crate are parallel to partition 7 and they include recessed shoulders 27, 28 that are substantially the same height as shoulders 24 of top edges 22, 23 of sides 5, 6.

As FIG. 1 clearly illustrates, on each of the side sections 5*a*, 5*b*, 6*a*, 6*b* there is one inwardly projecting element (29, 30, 31, 32) integrally formed therein. There are also reinforcing ribs 33–38 along the sides. Ribs 39 extend along the bottom of the crate in a conventional manner.

The uses and advantages of a container crate according to the invention shall now be described.

As described earlier, partition 7 enables the crate to be divided into two properly ventilated compartments. Air circulation is provided by apertures 19, 20 in the sides in a conventional manner and by apertures 21 in partition 7, as well as the recessed shoulders 27, 28 of the sides which allow air to circulate between two stacked crates, as shown by reference numerals 40, 41 in FIG. 5. Note that air circulates better at this level because distance $L_1$ between sides 3 and 4 of a crate at the level of the resulting gaps is substantially greater than distance $l_1$ between sides 5, 6 of a crate perpendicularly placed on top, when measured from the bottom of the crate. Similarly, distance $L_2$ between sides 5, 6 of the crate measured at the top edges, is less than distance $L_1$ between sides 3 and 4, measured at the recessed shoulders 27, 28.

According to a preferred embodiment, the crate contains two compartments and as an example, the following dimensions will be used: $l_1=505$ mm, $l_2=540$ mm, $L_1=580$ mm, $L_2=550$ mm.

The reinforcing tabs 16 provided make the dual compartment crate at least as rigid as if it had only a single compartment, preventing the crate from buckling around the axis formed by ridge 10 at the top of partition 7.

Figure 6:
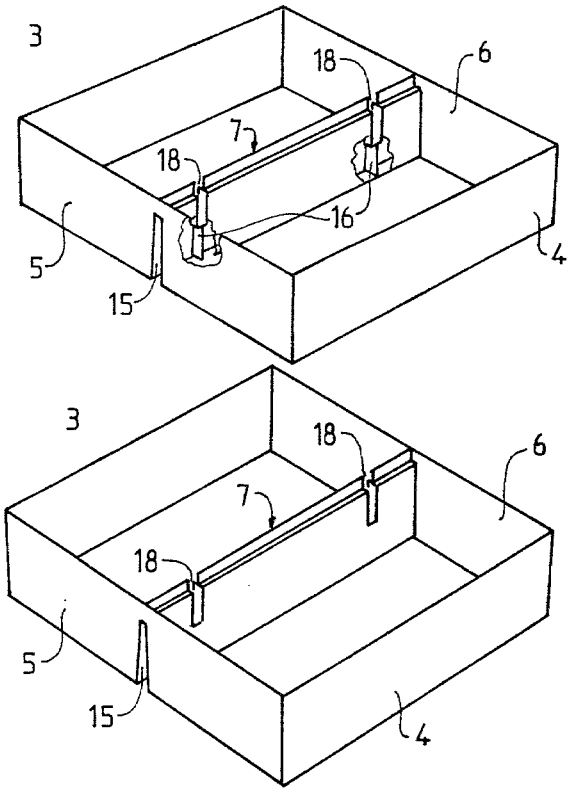
FIG. 6 is a perspective drawing, like FIG. 4, of the container crates ready to be nested one within the other.

Notches 18 do not appreciably weaken partition 7, and as FIG. 6 clearly shows, they enable the crates to be nested within one another by accommodating mating tabs 16.

Figure 4:
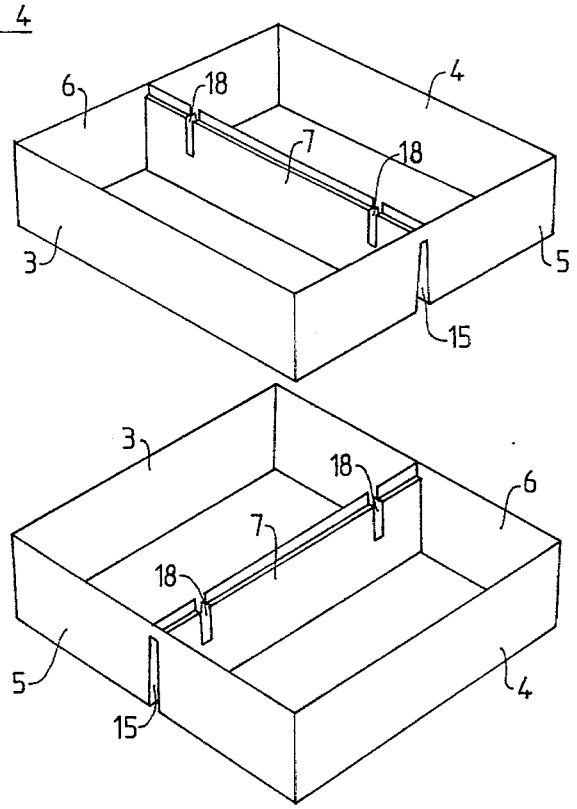
FIG. 4 is a perspective drawing of two container crates in position for vertical stacking, one on top of the other.

The crates are rotated 90 degrees so that they can be stacked one on top of the other, as shown in FIGS. 4 and 5. The top crate is supported not only by its bottom edges 42 and 43 (FIG. 5), which rest on the two top shoulders 24 of the crate below, but is also supported cross-wise by the top surface 26 of ridge 10 of the crate beneath it. In this way, each crate rests on the case beneath it along basically continuous support lines forming an H created by the two shoulders 24 and the ridge surface 26. This provides improved rigidity and stability of the stacks.

One of the advantages of plastic, especially if it is smooth, is that the crates can be properly cleaned and then re-used while maintaining proper sanitary standards. On the other hand, if the bottom is smooth, the animals inside will slide during shipping, which is harmful. To avoid this, a piece of cardboard cut to fit the bottoms 2*a*, 2*b* of each compartment 8, 9 is used as a disposable bottom (not shown). Each piece of cardboard is easily inserted and is kept in place by projecting elements 29, 31 and 30, 32 which protrude slightly inside the crate. The animals will not slide on the cardboard. In addition, the crate is easier to clean after use once the cardboard is discarded.

Of course, many variations are possible, especially in the shape and size of the crates and in the number of cross-wise partitions which can be increased. Therefore, the invention includes all technical equivalents of the methods described as well as any combination thereof, if these are based on the invention's ideas or on the claims that follow.

I claim:

1. A container crate of molded plastic or similar material, comprising a bottom and four sides forming a basically rectangular structure of the type that can be rotated 90 degrees in relation to other such crates to provide two stacking possibilities—either nesting within one another with considerable overlap of the sides, for compact storage or shipping of empties, or stacking of crates on top of each other with very little overlap but with the sides interlocking to prevent the stacked crates from sliding relative to each other, said crate further comprising:

at least one partition parallel to two of the crate's sides, which divides the crate into at least two compartments, step down stacking shoulders extending substantially the length of the other two sides, said partition protruding from the bottom of the crate and having a ridge at its top extending substantially at the level of the shoulders, the partition having the cross-sectional shape of an inverted V or symmetrical, inverted, short-stemmed Y forming a downward-opening groove between the two compartments, the crate further including:

at least one reinforcing tab connecting the two sides of said V near the bottom of the crate, with the tab being tapered, and at least one notch formed through the ridge and the upper part of said partition, the notch being directly located above and adapted for receiving a tab and into which the tab of a crate above is inserted when the crates nest within one another, said tab and notch being of similar width for permitting secured interlocking relation therebetween, and wherein said ridge and shoulders provide interlocking support during stacking.

2. A container crate as claimed in claim 1 further wherein two tabs are provided near two opposing sides of the crate, symmetrically in relation to a median parallel to the sides.

3. A container crate as claimed in claim 1 wherein the tab is connected to the bottom of the crate and extends to half the height of the crate while the notch extends from the top to a distance substantially half the height of the crate.

4. A container crate as claimed in claim 3 wherein the partition includes slots for ventilation in both sides thereof and near the apex thereof.

5. A container crate as claimed in claim 1 wherein each of the opposing sides perpendicular to said partition, in each of the crate's compartments, includes at least one inwardly projecting element.

* * * * *